US007304303B2

(12) United States Patent
McLaughlin et al.

(10) Patent No.: US 7,304,303 B2
(45) Date of Patent: Dec. 4, 2007

(54) SEARCHING FOR LOST ITEM

(75) Inventors: William E McLaughlin, Philadelphia, PA (US); Richard Jenkins, Glenside, PA (US)

(73) Assignee: LIRSI, Newtown, PA (US)

( * ) Notice: Subject to any disclaimer, the term of this patent is extended or adjusted under 35 U.S.C. 154(b) by 208 days.

(21) Appl. No.: 10/961,851

(22) Filed: Oct. 8, 2004

(65) Prior Publication Data

US 2005/0045823 A1 Mar. 3, 2005

Related U.S. Application Data

(60) Continuation-in-part of application No. 10/015,798, filed on Nov. 2, 2001, now Pat. No. 6,803,575, which is a division of application No. 09/235,618, filed on Jan. 21, 1999, now Pat. No. 6,842,108.

(51) Int. Cl.
*G01J 5/00* (2006.01)

(52) U.S. Cl. ..... 250/338.1

(58) Field of Classification Search ..... 250/338.1
See application file for complete search history.

(56) References Cited

U.S. PATENT DOCUMENTS

| | | | | |
|---|---|---|---|---|
| 4,158,853 | A * | 6/1979 | Sullivan et al. | 348/157 |
| 4,991,851 | A * | 2/1991 | Melesio | 473/200 |
| 5,651,741 | A * | 7/1997 | Masutani et al. | 473/200 |
| 5,662,533 | A | 9/1997 | Chadwell | |
| 6,120,394 | A * | 9/2000 | Kametani | 473/378 |
| 6,462,303 | B1 * | 10/2002 | Brown | 219/121.69 |
| 6,803,575 | B2 * | 10/2004 | McLaughlin | 250/338.1 |
| 2004/0138007 | A1 * | 7/2004 | Kim et al. | 473/371 |

* cited by examiner

*Primary Examiner*—David Porta
*Assistant Examiner*—Christine Sung
(74) *Attorney, Agent, or Firm*—John R. Ewbank

(57) ABSTRACT

An item that might be lost is provided with a badge featuring an array of glass beads. In seeking to retrieve such a lost item, an atmospheric-penetrating beam of laser is directed into the search area, and the signals from a reflectometer are monitored. The item having the badge of the array of glass beads is more easily retrievable when lost or mislaid than an item without such badge.

1 Claim, No Drawings

SEARCHING FOR LOST ITEM

CROSS-REFERENCE

This is a continuation-in-part of McLaughlin Ser. No. 10/015,798 filed Nov. 2, 2001, U.S. Pat. No. 6,803,575 of Oct. 12, 2004, which was a division of U.S. Pat. No. 6,842,108 from Ser. No. 09/235,618 filed Jan. 21, 1999.

RELATIONSHIP TO U.S. Pat. No. 6,803,575

Not only is this a continuation in-part of U.S. Pat. No. 6,803,575, but there is also the commitment that this and said U.S. Pat. No. 6,803,575 will always have common ownership. Although selected segments of U.S. Pat. No. 6,803,575 are repeated herein, the entire disclosure of U.S. Pat. No. 6,803,575 is deemed here reiterated.

BACKGROUND

Searching for lost items has been a problem for millennia. For example, dozens of patents have described methods for seeking to retrieve a temporarily lost golf ball.

Horchler U.S. Pat. No. 3,782,730 uses a magnetically actuated switch to turn on or off a radio oscillator at the core of the golf ball, whose radio signal can be monitored by the player whenever the ball is temporarily lost.

Engimeier U.S. Pat. No. 5,423,439 employs a rechargeable battery and a system for electromagnetically transmitting energy to the battery charger of a Horchler type of golf ball.

Little U.S. Pat. No. 5,626,531 employs a capacitance system which tags such ball whenever activated by the radiation from a Horchler-type of target-seeking monitor.

Kroll et al U.S. Pat. No. 5,662,534 also uses a monitor sending out a series of pulses of radio beams, and analyzing the reflected radio waves. In Kroll et al, the golf ball features a generic reflector of such radio beams.

Valintino U.S. Pat. No. 5,132,622 employs a golf ball having a metal center and the combination of a metal detector and target-seeking scoop to retrieve a lost golf ball.

Chadwell U.S. Pat. No. 6,552,433 seeks to locate a golf ball by metal detection and/or Radar, suggesting several modifications, some designed to measure the distance to the lost golf ball.

Barnhill U.S. Pat. No. 5,112,055 prepares a spherical golf ball, and then creates a cavity in which a signal-generator is installed that is activated by the hitting of the ball.

Kuesters U.S. Pat. No. 6,113,504 provides a golf course with a plurality of radio receivers so that a computer can, by triangulation of the intensities of the various receivers, locate the landing spot for a golf ball emitting the pertinent radio signals.

Relatively large targets, such as automobiles respond better to the traditional radar systems. Moreover, a golf ball containing significant mass of transmitter, tagging components, capacitors, etc. has flight characteristics which are dysfunctional. Although radio wave technology for locating a lost golf ball has offered a variety of suggestions in patent literature, very few golfers have located lost golf balls using radio waves. The problem of locating lost golf balls has persisted. Around the world, the number of golf balls manufactured, has continued to be significant through the decades, thus accentuating the long-standing-need for a system for retrieving a temporarily lost golf ball.

Similar problems occur with croquet balls and other sports paraphernalia. Model airplanes and creatures are sometimes temporarily lost, and are retrievable using the apparatus and method of the present invention.

Baker U.S. Pat. No. 5,370,387 applies a fluorescent coating on a golf ball and locates it with a lamp emitting ultra-violet light.

Digital pulses of laser beams having a wavelength of 1310 nm are suitable for optical wireless systems over distances of a few kilometers, according to Heatley et al, IWWW Communications magazine, December 1998, pp 72-82. Such direct line communication by laser beams has selected advantages over radio transmission, including privacy, difficulty of jamming, etc.

Not only in communication systems but in any long distance use of laser beams, there has been the long term recognition of the desirability of using one of the three "window" generally referred to as laser bean having an explicit wave length selected from the atmospheric-penetrating group consisting of 880 nm, 1310 nm, and 1550 nm. One advantage of such atmospheric penetrating laser beams is that they can travel long distances.

It has long been known that gratings could selectively reflect light within a very narrow range of wavelengths, and such gratings have been used in some selected retroreflectivity investigations.

The retroreflectivity of arrays of glass micro-reflectors has been much studied, primarily in connection with the retroreflectivity of the headlights of a vehicle. Varnishes, enamels, paints, etc. containing glass microreflectors have been much used to reflect the headlights of automobiles. Tapes featuring such arrays of microreflectors have been widely used. One brand of such reflective tape is marketed by MMM as Scotchguard reflector tape. The evolution of retroreflectivity technology has been significantly generic, although certain innovations concerned glass bead paints, and/or glass bead tapes, and/or partially embedded glass beads, and/or other types of arrays of glass beads.

Cube-corner microreflectors, prism microreflectors, and spherical microreflectors and other types of microreflectors have been generically called glass beads even though reflective glass microbeads might be more precise.

Various reflectometers have been used to measure such reflectivity of road marking featuring glass beads. In order to measure such reflectivity during daylight while a vehicle is travelling at traffic speeds, a laser beam can be employed to measure the retroreflectivity of the glass beads. As explained by Perrin et al at Road Management and Engineering Journal, September, 1998, pp 1-8, highway maintenance engineers employ laser reflectometers such as the Laserlux device for this purpose.

In the parent and grandparent application, a laser beam having an explicit wave length selected from the atmospheric-penetrating group consisting of 880 nm, 1310 nm, and 1550 nm is employed to seek to retrieve a lost item having a badge retroreflecting such laser beam, and monitoring the signal generated by such retroreflected light. For example a grating can be molded into the dimples of a golf ball, thereby making it feasible to use a monitoring device to search for a temporarily lost golf ball. Such a monitoring device would also be useful in searching for a lost lamb or other critter wearing a badge responsive to the laser beam.

SUMMARY OF INVENTION

In accordance with the present invention, an effort is made to retrieve a lost item using the method and apparatus of parent U.S. Pat. No. 6,803,575 and using an array of glass beads in the badge for selectively retroreflecting the laser beam.

EXAMPLE 1

Small patches of reflecting tape [Scotchlite-7810] were applied to one zone of a golf ball, thus providing a "badge" of selective reflectivity, while the diametrically opposite side of the golf ball was untreated.

A monitoring device designed for reading large drawings when seeking to prepare compact digitized data suitable for imaging such large drawings comprises a detector of the intensity of retroreflected light, an amplifier for such detected signal, and all audio device responsive to the magnitude of the reflected light. Such monitoring device also includes a generator for a narrow, low wattage laser beam, a scanning mirror adapted to direct such laser beam so that it linearly oscillates within a narrow [about 5 degrees] angle to provide a narrow scanning laser beam.

When the laser beam is directed at the portion of the golf ball lacking the badge of the array of glass beads, no audio signal is generated. When the laser beam is directed at the badged portion of the golf ball, then the audio signal is quite noticeable. The array of glass beads stimulates the retroreflectivity of the laser beam even though the portion of the golf ball without such array of glass beads does not stimulate such retroreflectivity. The usefulness of badges for seeking to retrieve a lost item is thus demonstrated. Such demonstration also exemplifies the retroreflectivity of glass beads for laser beams, but uniquely clarifies an application of utilizing laser retroreflectivity as a technique for retrieving lost items.

EXAMPLE 2

A golf ball is prepared so that an array of glass beads are bonded to the surfaces of at least a large portion of the dimples of a golf ball uniformly around the golf ball. One experimenter places such a golf ball in the grass at a distance such that it cannot be seen and then challenges the other experimenter to try to locate it using the apparatus of Example 1. Using the absence, presence, and intensity of the audio signals the second experimenter quickly locates the previously undetectable golf ball. By a series of tests, it is shown that the location of such a golf ball call be detected by directing the scanning laser beam into the targeted area and scanning until the monitoring of the audio sound provides the guidance for locating the ball. The intensity of the audio signal increases as the searcher moves closer to the temporarily lost ball. Such remote testing confirms the practical usefulness of glass bead reflectivity of a laser beam for searching for an item lost at a remote distance in an environment such as grass tending to obscure the lost item.

EXAMPLE 3

A monitoring device equivalent to that of Examples 1 and 2 is prepared using a laser beam leaving an explicit wave length selected from the atmospheric penetrating group consisting of 880 nm, 1310 nm, and 1550 nm. For safety reasons, the wattage of the laser beam should desirably be less than about 0.01 microwatts. The monitoring device is useful in locating on a golf course a lost golf ball having such array of glass micro-reflectors in its dimples.

Various modifications of the invention are possible without departing from the scope of the appended claims.

The invention claimed is:

1. The method of seeking to retrieve an item that has been lost which method comprises imparting to the outer surface of such item a hologram by securing thereto retroreflective glass bead components selectively responsive to a laser beam having an explicit wave length selected from the atmospheric penetrating group of wavelengths selected from the group consisting of 880 nm, 1310 nm and 1550 nm; directing from a monitoring device controlled by a searcher and initially remote from said temporarily lost item, a laser beam having the explicit wavelength corresponding to the wavelength for which said hologram is selectively responsive, said laser beam being directed into a search zone in which the temporarily lost item is believed to be, and said laser beam stimulating the reflection from such components of feedback light; said monitoring device comprising receptor cells responsive to such feedback light, such receptor cells generating an electrical signal; said monitoring device comprising amplifying means for amplifying such electric signal; said monitoring device comprising indicating means actuated by such amplifying means for alerting the searcher to the varying intensity of such indicating means when the laser beam scans a search zone possibly containing such temporarily lost item.

* * * * *